US007911491B2

(12) United States Patent
Gong et al.

(10) Patent No.: US 7,911,491 B2
(45) Date of Patent: Mar. 22, 2011

(54) APPARATUS AND METHOD FOR CONTROLLING POWER OF LASER DIODE HAVING OPTICAL POWER COMPENSATION

(75) Inventors: Jung-tag Gong, Suwon-si (KR); Goo-soo Gahang, Yongin-si (KR); Doo-Jin Bang, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 994 days.

(21) Appl. No.: 10/992,007

(22) Filed: Nov. 19, 2004

(65) Prior Publication Data

US 2005/0128281 A1 Jun. 16, 2005

(30) Foreign Application Priority Data

Nov. 20, 2003 (KR) ..... 10-2003-0082651

(51) Int. Cl.
*B41J 2/435* (2006.01)

(52) U.S. Cl. ..... 347/236; 347/246

(58) Field of Classification Search ..... 347/129, 347/132–136, 236–237, 246–247, 253; 250/235; 372/29.02, 31, 38.02, 380.2, 38.1; 359/333; 399/48, 50

See application file for complete search history.

(56) References Cited

U.S. PATENT DOCUMENTS 4,237,427 A 12/1980 Holland
4,577,320 A 3/1986 Yoshikawa et al.
4,611,270 A 9/1986 Klauminzer et al.
4,774,710 A 9/1988 Davis et al.
4,794,413 A * 12/1988 Yamazaki et al. ..... 347/247
4,862,289 A * 8/1989 Shimada ..... 347/247
5,184,578 A 2/1993 Quinn et al.
5,222,072 A 6/1993 Oku
5,225,850 A 7/1993 Egawa et al.
5,276,781 A 1/1994 Chang et al.
5,369,272 A * 11/1994 Eguchi ..... 250/235
5,579,328 A * 11/1996 Habel et al. ..... 372/31
5,701,283 A 12/1997 Alon et al.
5,754,577 A 5/1998 Casper et al.
5,838,359 A * 11/1998 Hoover ..... 347/250
5,854,652 A * 12/1998 Andersen ..... 347/246

(Continued)

FOREIGN PATENT DOCUMENTS

JP 63053043 A * 3/1988

(Continued)

OTHER PUBLICATIONS

PID Controller from Wikipedia, the free encyclopedia, pp. 1-7 (in English).

(Continued)

*Primary Examiner* — Hai C Pham
(74) *Attorney, Agent, or Firm* — Staas & Halsey LLP

(57) ABSTRACT

An apparatus includes an output voltage sensing unit, which senses an output voltage of a laser diode, which has been sampled during a power control period and transmits the sensed output voltage of the laser diode to an output voltage control unit; the output voltage control unit, which obtains an error voltage between a reference voltage and the sensed output voltage of the laser diode and generates a control voltage by proportionally integrating the error voltage; and an optical power compensation unit, which receives the control voltage and generates a compensated control voltage by compensating for an optical power deviation on the photosensitive drum during the printing period.

12 Claims, 7 Drawing Sheets

U.S. PATENT DOCUMENTS

| | | | | |
|---|---|---|---|---|
| 5,961,857 | A * | 10/1999 | Takahashi et al. | 219/121.62 |
| 5,966,159 | A | 10/1999 | Ogasawara | |
| 5,973,719 | A * | 10/1999 | Araki et al. | 347/253 |
| 6,151,344 | A | 11/2000 | Kiely et al. | |
| 6,222,580 | B1 * | 4/2001 | Yamada | 347/247 |
| 6,223,006 | B1 * | 4/2001 | Scheuer et al. | 399/48 |
| 6,229,833 | B1 | 5/2001 | Noda et al. | |
| 6,278,476 | B1 * | 8/2001 | Ueno | 347/247 |
| 6,288,733 | B1 | 9/2001 | Nakazawa et al. | |
| 6,370,175 | B1 * | 4/2002 | Ikeda et al. | 372/38.1 |
| 6,690,693 | B1 | 2/2004 | Crowder | |
| 6,775,216 | B2 | 8/2004 | Kelly et al. | |
| 6,795,099 | B2 * | 9/2004 | Koga et al. | 347/129 |
| 7,061,951 | B2 * | 6/2006 | Fairgrieve et al. | 372/38.02 |
| 7,492,796 | B2 * | 2/2009 | Hwang | 372/29.02 |
| 2001/0028383 | A1 | 10/2001 | Mutou et al. | |
| 2002/0036688 | A1 | 3/2002 | Saito et al. | |
| 2002/0121094 | A1 | 9/2002 | VanHoudt | |
| 2003/0016961 | A1 * | 1/2003 | Kitajima | 399/50 |
| 2003/0142706 | A1 | 7/2003 | Kartner et al. | |
| 2004/0057476 | A1 * | 3/2004 | Hwang | 372/29.02 |
| 2004/0156094 | A1 * | 8/2004 | Kawahara et al. | 359/333 |
| 2005/0028770 | A1 | 2/2005 | McCabe | |
| 2005/0078723 | A1 * | 4/2005 | Han et al. | 372/38.02 |
| 2005/0128281 | A1 | 6/2005 | Gong et al. | |
| 2006/0056471 | A1 * | 3/2006 | Ueno | 372/38.02 |
| 2006/0140231 | A1 | 6/2006 | Han | |

FOREIGN PATENT DOCUMENTS

| | | | |
|---|---|---|---|
| JP | 06-274019 | | 9/1994 |
| JP | 08-015631 | | 1/1996 |
| JP | 08-043752 | | 2/1996 |
| JP | 2000-031577 | | 1/2000 |
| JP | 2000-052590 | | 2/2000 |
| JP | 2000349376 | A * | 12/2000 |
| JP | 2002236400 | A * | 8/2002 |
| JP | 2003043400 | A * | 2/2003 |

OTHER PUBLICATIONS

U.S. Office Action for related U.S. Appl. No. 10/646,923; mailed Jun. 9, 2005.

U.S. Office Action for related U.S. Appl. No. 10/646,923; mailed Nov. 28, 2005.

U.S. Office Action for related U.S. Appl. No. 10/646,923; mailed Jun. 20, 2006.

U.S. Office Action for related U.S. Appl. No. 10/646,923; mailed Jan. 5, 2007.

U.S. Office Action for related U.S. Appl. No. 10/646,923; mailed Aug. 9, 2007.

U.S. Office Action for related U.S. Appl. No. 10/646,923; mailed Apr. 1, 2008.

U.S. Office Action for related U.S. Appl. No. 10/646,923; mailed Aug. 21, 2008.

U.S. Notice of Allowance for related U.S. Appl. No. 10/646,923; mailed Dec. 8, 2008.

* cited by examiner

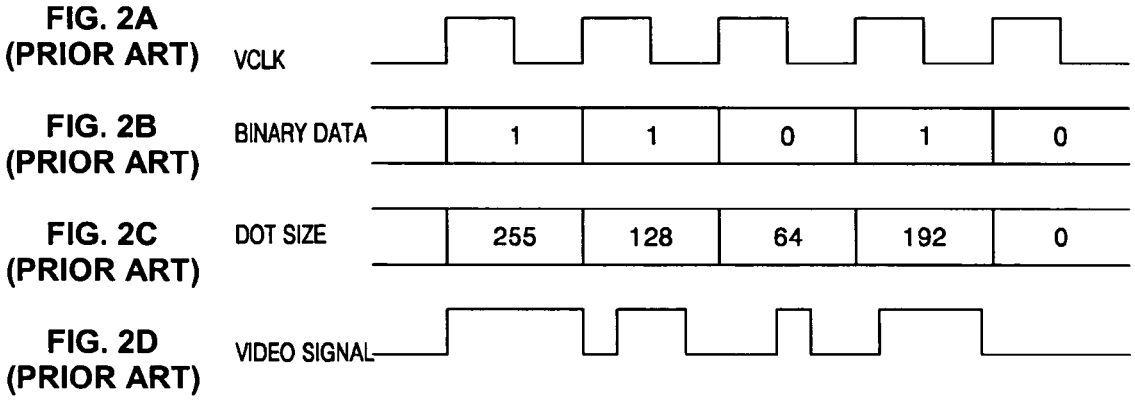
FIG. 3
(PRIOR ART)
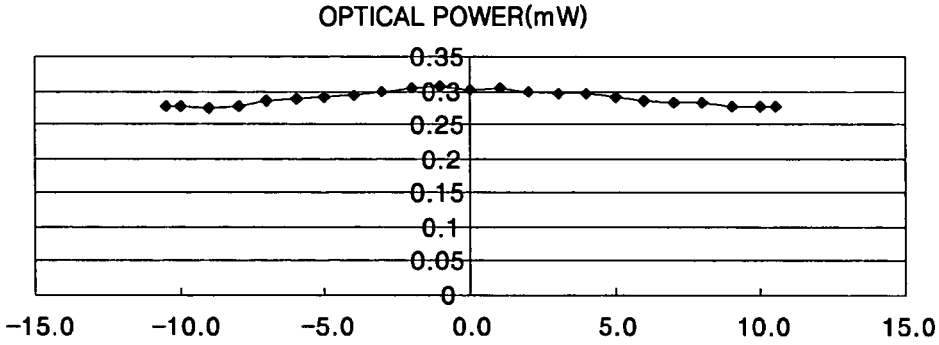

VCLK

BINARY DATA
1
1
0
1
0

DOT SIZE
255
128
64
192
0

VIDEO SIGNAL

COMPENSATION VALUE
0.5
1.2
1.0
0.8
0.4

COMPENSATED VIDEO SIGNAL

APPARATUS AND METHOD FOR CONTROLLING POWER OF LASER DIODE HAVING OPTICAL POWER COMPENSATION

CROSS-REFERENCE TO RELATED APPLICATION

This application claims the benefit of Korean Patent Application No. 2003-82651, filed on Nov. 20, 2003, in the Korean Intellectual Property Office, the disclosure of which is incorporated herein in its entirety by reference.

BACKGROUND OF THE INVENTION

1. Field of the Invention

The present invention relates to a method of controlling power of a laser diode, and more particularly, to a method and apparatus for controlling power of a laser diode, which can obtain an output image with high quality by controlling driving voltage of the laser diode that scans a laser beam on a photosensitive drum so as to compensate for an optical power deviation between both sides of the photosensitive drum.

2. Description of the Related Art

In general, a laser printer is an apparatus that forms an image using a laser beam, emitted from a laser diode in response to a video signal of an input image, on a photosensitive drum and transfers a resultant latent image formed on the photosensitive drum onto a medium, such as a piece of paper, thereby realizing the input image.

FIG. 1 is a block diagram of a conventional apparatus for driving a laser diode. Referring to FIG. 1, the conventional apparatus includes an image processing unit 100, a pulse width modulation (PWM) unit 110, a digital-to-analog conversion unit 130, a laser diode driving unit 120, and a laser scanning unit 140 that comprises a laser diode and a light receptor, such as a photo diode.

The image processing unit 100 determines the size of each dot to be printed by applying a resolution algorithm to input binary data.

The PWM unit 110 generates a pulse signal based on information on the size of each dot to be printed.

The digital-to-analog conversion unit 120 receives the pulse signal from the PWM unit 110 and converts the received pulse signal, which is a digital signal, into an analog signal for driving the laser diode.

The laser diode driving unit 130 receives the analog signal from the digital-to-analog conversion unit 120 and drives the laser diode in the laser scanning unit 140 using the received analog signal.

FIGS. 2A-2D are waveform diagrams illustrating signals input to/output from the elements of the conventional apparatus for driving a laser printer of FIG. 1. Referring to FIGS. 2A-2D, binary data, which consists of "1"s and "0"s, is input to the image processing unit 100. The image processing unit determines 100 the size of each dot to be printed (where each dot to be printed may have a size of, for example, 0-255) by applying the resolution algorithm to the input binary data and outputs information on the size of each dot to be printed to the PWM unit 110.

The PWM unit 110 converts the information on the size of each dot to be printed into a video signal through PWM and outputs the video signal to the digital-to-analog conversion unit 120. The laser diode driving unit 130 adds a predetermined level of laser diode driving voltage to the video signal, thereby driving the laser diode.

However, even though the laser diode driving voltage applied to the laser diode is maintained at a constant level, optical power accumulated on the surface of the photosensitive drum may vary for many reasons. Therefore, it is necessary to maintain the optical power accumulated on the surface of the photosensitive drum at a constant level.

One of the reasons for the variation of the optical power accumulated on the surface of the photosensitive drum is the structural mechanism of the laser scanning unit 140. In other words, even when the laser diode scans a laser beam with a constant level of power, the optical power accumulated on the surface of the photosensitive drum varies from positions of the photosensitive drum.

FIG. 3 is a diagram illustrating optical power accumulated on the photosensitive drum that differs from position of the surface of the photosensitive drum. Referring to FIG. 3, optical power is lower at either side of the photosensitive drum than at the center of the photosensitive drum due to a polygonal mirror and a lens installed in the laser scanning unit 140. Therefore, the quality of printing at either side of printing paper differs from the quality of printing at the center of the printing paper.

SUMMARY OF THE INVENTION

Additional aspects and/or advantages of the invention will be set forth in part in the description which follows and, in part, will be obvious from the description, or may be learned by practice of the invention.

An aspect of the present invention provides a method and apparatus for controlling power of a laser diode, which can obtain an output image with high quality by controlling driving voltage of the laser diode that scans a laser beam on a photosensitive drum and thus compensating for an optical power deviation between both sides of the photosensitive drum.

According to an aspect of the present invention, there is provided an apparatus for controlling power of a laser diode, which generates a control voltage by compensating for an optical power deviation on the surface of a photosensitive drum of an image forming apparatus, such as a laser printer, during a power control period and applies the control voltage to a laser diode during a printing period. The apparatus comprises an output voltage sensing unit, which senses an output voltage of the laser diode, which has been sampled during the power control period and transmits the sensed output voltage of the laser diode to an output voltage control unit; the output voltage control unit, which obtains an error voltage between a reference voltage and the sensed output voltage of the laser diode and generates a control voltage by proportionally integrating the error voltage; and an optical power compensation unit, which receives the control voltage and generates a compensated control voltage by compensating for an optical power deviation on the photosensitive drum during the printing period.

According to an aspect of the present invention, the output voltage control unit proportionally integrate the error voltage during the power control period and transmits a proportional integration result to the optical power compensation unit.

According to an aspect of the present invention, the optical power compensation unit includes an optical power deviation storage, which stores the optical power deviation on the photosensitive drum; and an adder/subtractor, which generates the compensated control voltage by adding/subtracting the optical power deviation stored in the optical power deviation storage to/from the control voltage during the printing period.

According to an aspect of the present invention, the output voltage sensing unit includes an analog-to-digital converter, which measures output voltages of the laser diode during the power control period and A/D converts the measured output voltages of the laser diode; and a calculator, which averages the A/D converted output voltages of the laser diode and transmits the average of the A/D converted output voltages of the laser diode to the output voltage control unit.

According to another aspect of the present invention, there is provided a method of controlling power of a laser diode, which generates a control voltage by compensating for an optical power deviation on the surface of a photosensitive drum of an image forming apparatus, such as a laser printer, during a power control period and applies the control voltage to a laser diode during a printing period. The method involves receiving an output voltage of a laser diode during the power control period and generating a control voltage based on the received output voltage of the laser diode; and generating a compensated control voltage by adding/subtracting the optical power deviation to/from the control voltage and applying the compensated control voltage to the laser diode.

According to an aspect of the present invention, the receiving output voltage includes sensing the output voltage of the laser diode during the power control period and generating an error voltage between the sensed output voltage of the laser diode and a reference voltage; and generating the control voltage by proportionally integrating the error voltage.

According to an aspect of the invention, the sensing output voltage includes A/D converting the output voltage of the laser diode; sampling the A/D converted output voltage of the laser diode; averaging resultant sampled output voltages of the laser diode; and generating an error voltage between the average of the sampled output voltages of the laser diode and the reference voltage.

According to an aspect of the present invention, the generating compensation signal includes measuring the optical power deviation on the surface of the photosensitive drum of the laser printer; and adding/subtracting the optical power deviation from the compensated control voltage during the printing period and applying an addition/subtraction result to the laser diode.

BRIEF DESCRIPTION OF THE DRAWINGS

These and/or other aspects and advantages of the invention will become apparent and more readily appreciated from the following description of the embodiments, taken in conjunction with the accompanying drawings of which:

FIGS. 2A through 2D a waveform diagrams illustrating signals input to/output from elements of the conventional apparatus for controlling power of a laser diode of FIG. 1;

FIG. 3 is a diagram illustrating optical power accumulated on a photosensitive drum that differs from portion to portion on the surface of the photosensitive drum;

DETAILED DESCRIPTION OF THE EMBODIMENTS

Figure 1:
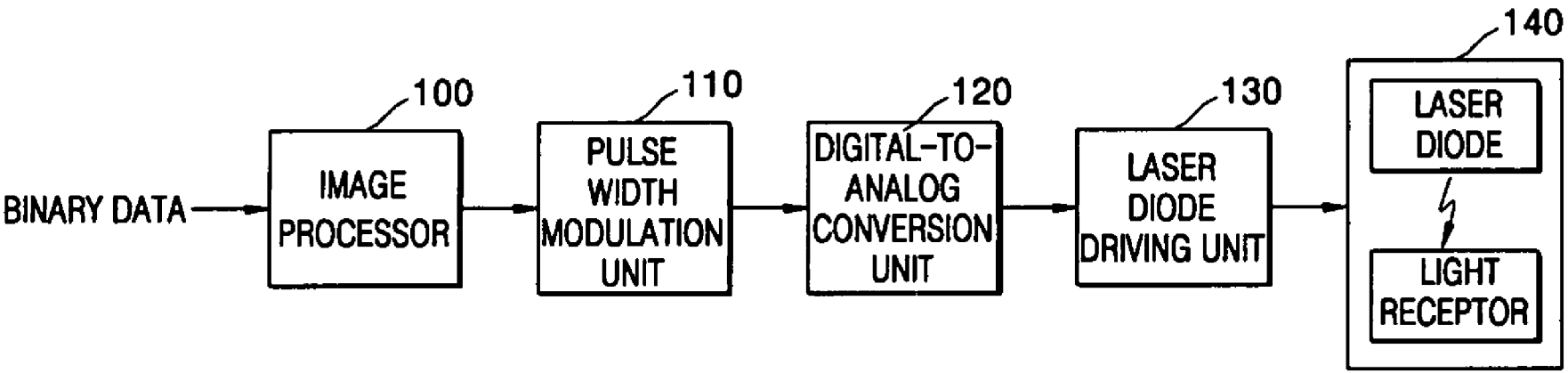
FIG. 1 (PRIOR ART)
FIG. 1 is a block diagram of a conventional apparatus for controlling power of a laser diode.

Reference will now be made in detail to the embodiments of the present invention, examples of which are illustrated in the accompanying drawings, wherein like reference numerals refer to the like elements throughout. The embodiments are described below to explain the present invention by referring to the figures.

Various technical features, such as circuits and means for driving circuits, will be mentioned through this disclosure for a better understanding of the present invention. However, it is obvious to those skilled in the art that the present invention can be embodied in various manners other than those set forth herein without adopting those technical features. Detailed explanations of conventional techniques and structures that are related to the present invention to some extent will be omitted if they are considered to make the concepts of the present invention unclear.

Figure 4:
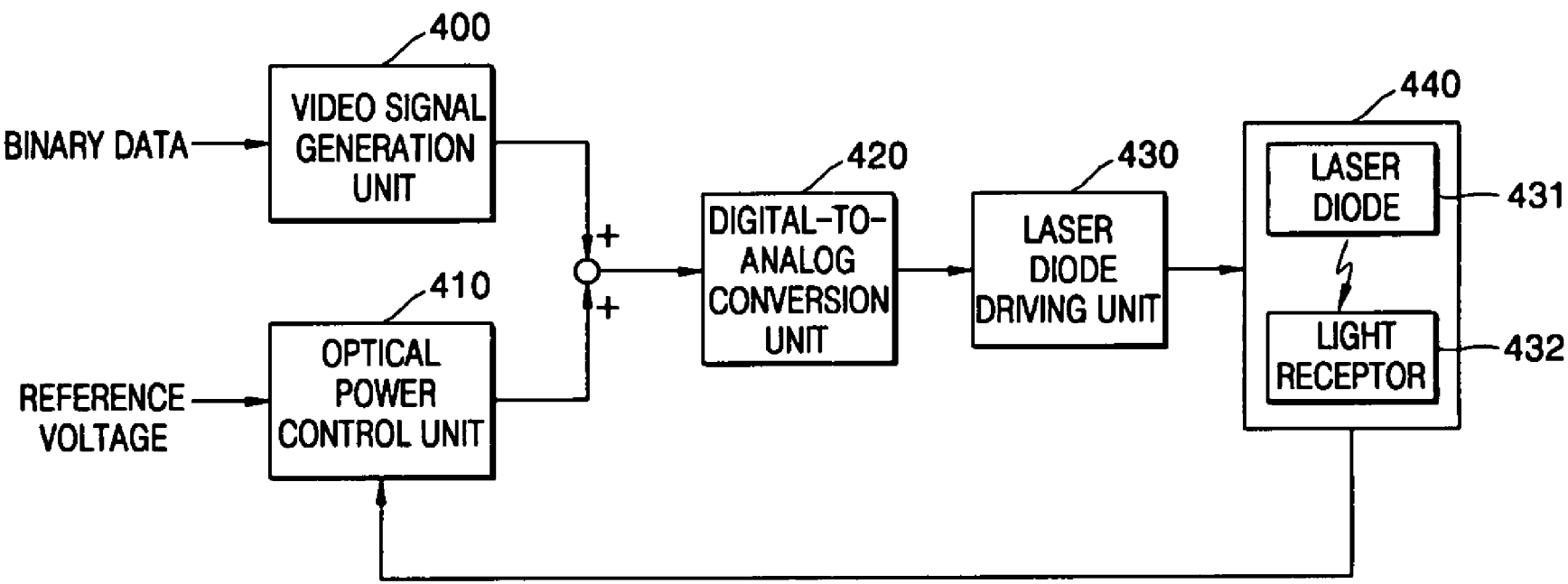
FIG. 4 is a block diagram of an apparatus for controlling power of a laser diode according to an embodiment of the present invention.

FIG. 4 is a block diagram of an apparatus for controlling power of a laser diode according to an aspect of the present invention. Referring to FIG. 4, the apparatus comprises a video signal generation unit 400, an optical power control unit 410, a digital-to-analog conversion unit 420, a laser diode driving unit 430, and a laser scanning unit 440. The laser scanning unit 440 includes a laser diode 431 and a light receptor 432, such as a photo diode.

The video signal generation unit 400 receives binary data, and generates a video signal having a predetermined dot size. According to an aspect of the invention, the video signal generation unit 400 further enhances the resolution of the received binary data by using a predetermined resolution enhancement algorithm.

The optical power control unit 410 generates a laser diode driving voltage during a power control period. The optical power control unit 410 compensates for the laser diode driving voltage during a power output period.

The video signal and the laser diode driving voltage are summed up during the power output period, and the summation result is input to the digital-to-analog conversion unit 420 so that the laser diode 431 can be driven.

The digital-to-analog conversion unit 420 converts the result of summing up the video signal output from the video signal generation unit 400 and the laser diode driving voltage output from the optical power control unit 410 into an analog voltage and applies the analog voltage to the laser diode driving unit 430.

The laser diode driving unit 430 drives and controls the laser diode 431 during the power output period by using the analog voltage received from the digital-to-analog conversion unit 420.

Figure 5:
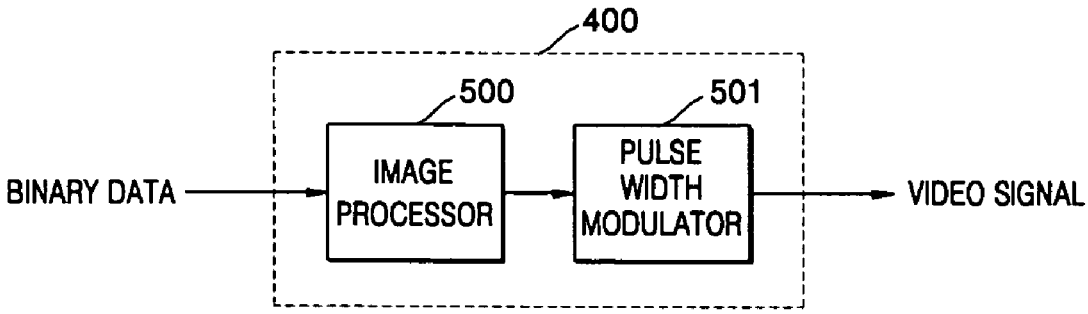
FIG. 5 is a detailed block diagram of a video signal generation unit of FIG. 4.

FIG. 5 is a detailed block diagram of the video signal generation unit 400 of FIG. 4 according to an aspect of the invention. Referring to FIG. 5, the video signal generation unit 400 includes an image processor 500 and a pulse width modulator 501.

The image processor 500 receives binary data and determines the size of each dot to be printed. According to an aspect of the invention, the image processor 500 further performs a resolution enhancement algorithm on the binary data.

The pulse width modulator 501 generates a pulse signal based on the determined size of each dot to be printed.

Figure 6:
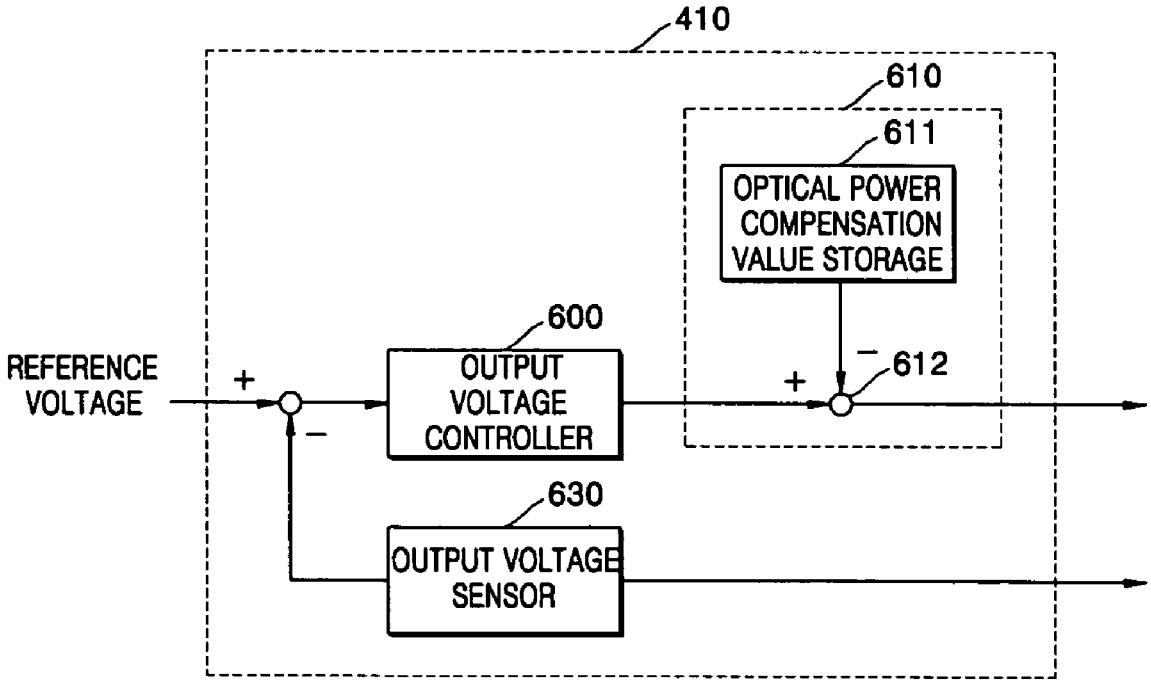
FIG. 6 is a detailed block diagram of an optical power control unit of FIG. 4.
Figure 7:
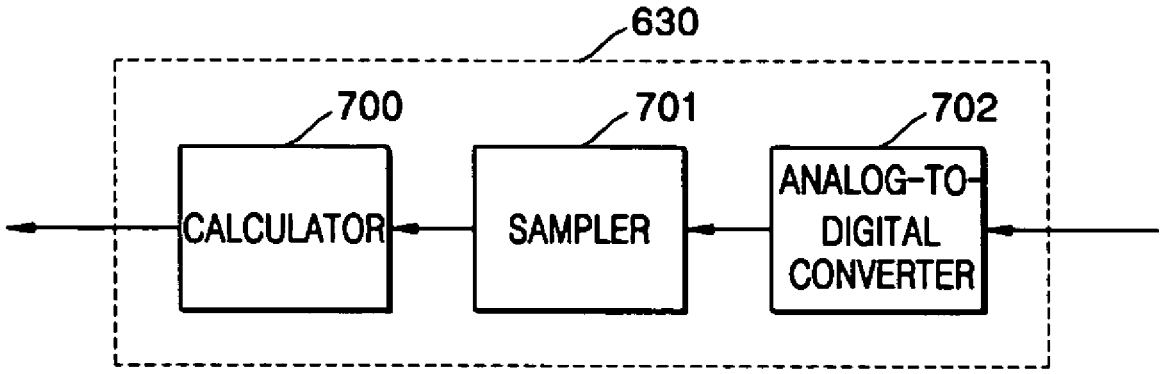
FIG. 7 is a detailed block diagram of an output voltage sensor of FIG. 6.

FIG. 6 is a detailed block diagram of the optical power control unit 410 of FIG. 4, and FIG. 7 is a detailed block diagram of an output voltage sensor 630 of FIG. 6 according to aspects of the invention. Referring to FIG. 6, the optical power control unit 410 includes an output voltage controller 600, an optical power compensator 610, and the output voltage sensor 630. The optical power compensator 610 includes an optical power compensation value storage 611 and an adder/subtractor 612.

Referring to FIG. 7, the output voltage sensor 630 includes a calculator 700, a sampler 701, and an analog-to-digital converter 702.

The output voltage controller 600 receives an error between a sensed output voltage of the laser diode 431 and a reference voltage and controls output voltage of the laser diode 431 not to deviate too much from the reference voltage during the power control period by using a predetermined control method. According to an aspect of the invention, the output voltage controller 600 uses a proportional integration control method to control the output voltage of the laser diode 431.

An example of proportional integration is set forth in U.S. patent publication No. 2004/57476, the disclosure of which is incorporated by reference. In an embodiment of this method, a proportional section of the controller 600 multiplies the error voltage by a proportional constant Kp to generate a proportional term. An integral section of the controller 600 accumulates the error voltage and multiplies the accumulated error voltage by an integral constant Ki to generate an integral term. An adder of the controller 600 adds up the proportional term and the integral term and outputs a result of the addition. The proportional constant Kp and the integral constant Ki are optimal values selected from the results of an actual control using a cut-and-try method. Where a subtractor is used to subtract the result for a reference value, the proportional-integral processor of the controller 600 can add a single sign bit to the output of a subtractor of the controller 600 in order to simplify a proportional-integral processing because a negative value may be generated as a result of the subtraction from the subtractor.

In the meantime, if the calculator 700 has multiplied an output of the sampler 701 by a predetermined multiplication constant for removal of a decimal fraction, the output voltage controller 600 divides the output voltage of the laser diode by the predetermined multiplication constant and then outputs the division result.

The optical power compensator 610 reads a predetermined value from the optical power compensation value storage 611, adds/subtracts the predetermined value to/from an output of the output voltage controller 600, which stores a voltage to be compensated for according to the position of the photosensitive drum, and outputs the addition/subtraction result.

The length and width of each line of printing paper each consist of several hundreds of dots. Before printing data on each line of the printing paper, the laser diode 431 generates an initiation signal. The dots of each line of the printing paper may be divided into several blocks according to how much the dots should be compensated for. While not required, it is understood that the dots can be divided based on experimental data. Therefore, the optical power compensation value storage 611 stores a predetermined voltage level by which each of the dots of the printing paper or each of the blocks should be compensated for in advance so that a printing process can be performed during the printing period after adding/subtracting the predetermined voltage level to/from the output of the optical power compensator 610 in response to the initiation signal.

The analog-to-digital converter 702 of the output voltage sensor 630 senses the output voltage of the laser diode 431 during the power control period and A/D converts the sensed output voltage of the laser diode 431.

The sampler 701 receives the A/D converted output voltage of the laser diode 431 and samples the A/D converted output voltage of the laser diode 431 a predetermined number of times to be in digital form.

The calculator 700 receives an output of the sampler 701 and performs a predetermined process on the output of the sampler 701. More specifically, the calculator averages output voltages of the laser diode 431 sampled during the power control period and inputs the average of the sampled output voltages of the laser diode 431 to the output voltage controller 600. For removal of a decimal fraction or removal of unnecessary noise, the calculator 700 may multiply the average of the sampled output voltages of the laser diode 431 by the predetermined multiplication constant, may detect a maximum and a minimum among the sampled output voltages of the laser diode 431 and select all of them but the maximum and the minimum or may select sampled output voltages of the laser diode 431.

FIGS. 8A through 8F are waveform diagrams illustrating signals input to/output from the elements of the apparatus for controlling power of a laser diode according to an aspect of the present invention. FIGS. 8A through 8F illustrate waveforms of reference clock, binary data, dot size, video signal, compensation value, and compensated video signal, respectively.

Figures 8A, 8B, 8C, 8D, 8E, 8F:
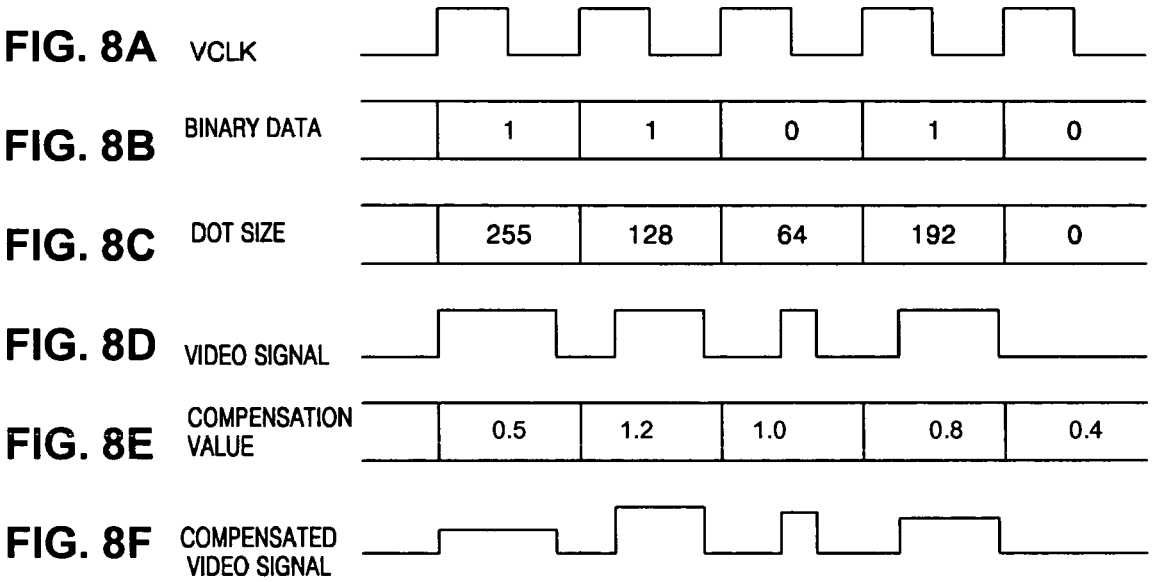
FIGS. 8A through 8F are waveform diagrams illustrating signals input to/output from elements of the apparatus for controlling power of a laser diode according to the preferred embodiment of the present invention.

Referring to FIG. 8, 'binary data' is data that is input from the outside in synchronization with a reference clock signal (i.e., VCLK shown in FIG. 8A) and is only comprised of "1"s and "0"s.

'Dot size' shown in FIG. 8C indicates the size of each dot to be printed and has a value of 0-255, which is obtained by processing 'binary data' with the use of a resolution enhancement algorithm. 'Video signal' shown in FIG. 8*d* indicates a pulse signal generated by the pulse width modulator 501 and shows the variation of a pulse width with the size of each dot to be printed.

As shown 'Dot size' is converted into a value between "0" and "255". White and black are represented by "0" and "255", respectively, and in-between colors are represented by numbers between "0" and "255". However, it is understood that other values may be used.

'Compensation value' shown in FIG. 8E indicates the extent to which a laser diode driving voltage at each portion of a photosensitive drum should be compensated for and varies depending on a distance from each portion of the photosensitive drum to the center of the photosensitive drum. A reference value for 'compensation value' is '1'.

'Compensated video signal' is a result of multiplying 'video signal' to 'compensation value'. As shown in FIGS. 8D and 8F, 'compensated video signal' and 'video signal' have the same dot size but different pulse heights. A difference in pulse height between 'compensated video signal' and 'video signal' is translated into a difference in brightness of each dot therebetween. For example, if 'compensation value' is set to 1.2, a compensated video signal is printed 20% darker than an original video signal.

Figure 9:
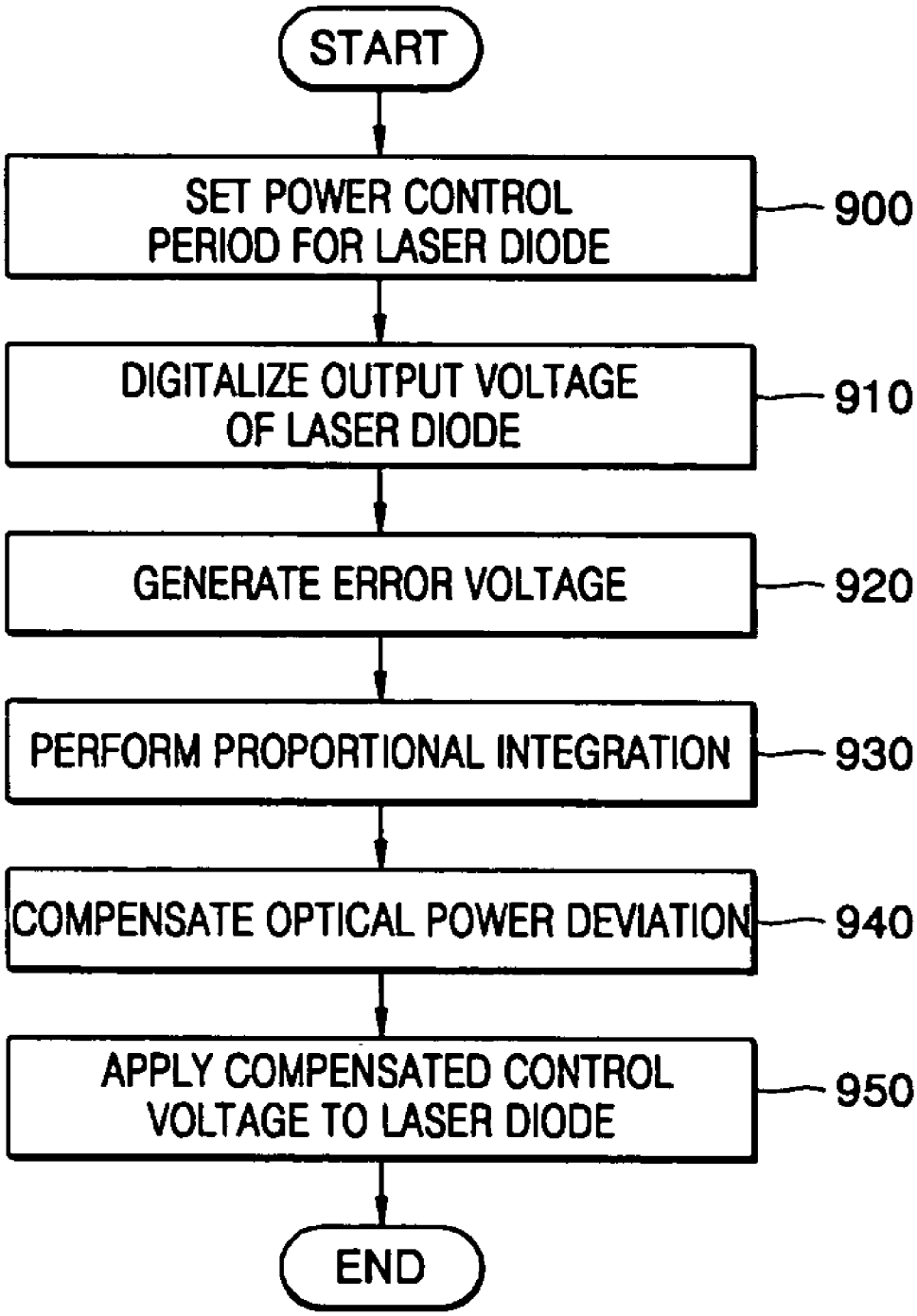
FIG. 9 is a flowchart of a method of controlling power of a laser diode according to an embodiment of the present invention.

FIG. 9 is a flowchart of a method of controlling power of a laser diode 431 according to a preferred embodiment of the present invention. Referring to FIG. 9, operations S900 through S930 are performed during a power control period, and operations S940 and S950 are performed during a printing period, i.e., a power output period.

In operation S900, a power control period is set for the laser diode 431.

In operation S910, output voltage of the laser diode 431 is digitalized.

In operation S920, the digitalized output voltage of the laser diode 431 is sampled a predetermined number of times, resultant sampled output voltages of the laser diode 431 are averaged, and an error voltage between a reference voltage and the average of the sampled output voltages of the laser diode 431 is obtained. Alternatively, in operation S920, among the sampled output voltages of the laser diode 431, only those which fall into a predetermined range may be selected for removing noise that may be included in the output voltage of the laser diode 431. Operation S920 may comprise multiplying the error voltage by a predetermined multiplication constant for removal of a decimal fraction according to one aspect of the invention, but can be otherwise determined.

In operation S930, the error voltage is proportionally integrated, thereby generating a control voltage. If the error voltage has been multiplied by the predetermined multiplication constant in operation S920, operation S930 may comprise dividing the proportional integration result by a predetermined division constant.

In operation S940, an optical power deviation between portions of the photosensitive drum is compensated for. The extent of compensation is determined by referring to the optical power compensation value storage 611. In the optical power compensation value storage 611, optical power deviations and compensation values, by which they should be respectively compensated for, are stored in a lookup table.

Before printing data on each line of printing paper, the laser diode 431 generates an initiation signal. Once the initiation signal is generated, dots of each line of the printing paper are divided into several blocks and compensation values, by which the blocks may respectively be compensated for; are stored on a block-by-block basis. It is understandable that the compensation values may be compensated based on a dot by dot.

In operation S950, a video signal and a compensated laser diode driving voltage are summed up, and the laser diode 431 is driven with the summation result during the printing period.

As described above, it is possible to obtain an output image with high quality by controlling a driving voltage of a laser diode that scans a laser beam on the photosensitive drum and thus compensating for an optical power deviation between both sides of the photosensitive drum. While a specific compensation scheme has been exemplified, it is understood that other compensation schemes can be used and which are based on feedback systems which may use only part of the lookup table or which do not require such a lookup table.

While the present invention has been particularly shown and described with reference to exemplary embodiments thereof, it will be understood by those of ordinary skill in the art that various changes in form and details may be made therein without departing from the spirit and scope of the present invention as defined by the following claims.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. An apparatus for controlling power of a laser diode, which generates a control voltage by compensating for an optical power deviation of the optical power accumulated on a surface of a photosensitive drum of an image forming apparatus during a power control period and applies the control voltage to the laser diode during a printing period, the apparatus comprising:

an output voltage sensing unit, which senses an output voltage of the laser diode and which has been sampled during the power control period;

an output voltage control unit, which receives the sensed output voltage of the laser diode and obtains an error voltage between a reference voltage and the sensed output voltage of the laser diode and proportionally integrates the error voltage to generate the control voltage; and an optical power compensation unit, which receives the generated control voltage and generates a compensated control voltage based on a predetermined compensation value corresponding to the optical power deviation, determined according to a position of the photosensitive drum, the predetermined compensation value to be one of directly added to and subtracted from the generated control voltage to compensate for the optical power deviation on the photosensitive drum during the printing period, wherein the optical power compensation unit comprises an optical power deviation storage which stores optical power deviations on the photosensitive drum and compensation values by which the optical power deviations should be respectively compensated.

2. The apparatus of claim 1, wherein the output voltage control unit proportionally integrates the error voltage during the power control period and transmits a proportional integration result to the optical power compensation unit.

3. The apparatus of claim 1, wherein the optical power compensation unit comprises:

a calculator, which generates the compensated control voltage by applying the optical power deviation stored in the optical power deviation storage to the control voltage during the printing period.

4. The apparatus of claim 1, wherein the output voltage sensing unit comprises:

an analog-to-digital converter, which measures output voltages of the laser diode during the power control period and A/D converts the measured output voltages of the laser diode into digital form; and a calculator, which averages the A/D converted output voltages of the laser diode and transmits the average of the A/D converted output voltages of the laser diode to the output voltage control unit.

5. A method of controlling power of a laser diode by compensating for an optical power deviation of optical power accumulated on a surface of a photosensitive drum of an image forming apparatus, the method comprising:

receiving an output voltage of a laser diode during a power control period and generating a control voltage based on the received output voltage of the laser diode;

storing in a look-up table optical power deviation values corresponding to positions of the photosensitive drum and compensation values for each of the optical power deviation values;

generating a compensated control voltage by one of directly adding and subtracting one or more of the stored compensation values corresponding to the optical power deviation from the generated control voltage to compensate for the optical power deviation of the photosensitive drum; and applying the compensated control voltage to the laser diode, wherein the receiving the output voltage of a laser diode and generating the control voltage comprises sensing the output voltage of the laser diode during the power control period, generating an error voltage between the sensed output voltage of the laser diode and a reference voltage, and proportionally integrating the error voltage to generate the control voltage.

6. The method of claim 5 wherein sensing the output voltage of the laser diode comprises:

A/D converting the output voltage of the laser diode;

sampling the A/D converted output voltage of the laser diode;

averaging resultant sampled output voltages of the laser diode; and generating an error voltage between the average of the sampled output voltages of the laser diode and the reference voltage.

7. A method of controlling power of a laser diode by compensating for an optical power deviation of optical power accumulated on a surface of a photosensitive drum of an image forming apparatus, the method comprising:

receiving an output voltage of a laser diode during a power control period and generating a control voltage based on the received output voltage of the laser diode by proportionally integrating an error voltage between the sensed output voltage of the laser diode and a reference voltage;

generating a compensated control voltage by directly adding and/or subtracting a predetermined compensation value corresponding to an optical power deviation with respect to the control voltage and applying the compensated control voltage to the laser diode, the predetermined compensation value being one of a plurality of predetermined compensation values stored in a storage and respectively corresponding to a plurality of optical power deviations, wherein generating a compensated control voltage comprises: measuring the optical power deviation on the surface of the photosensitive drum of the image forming apparatus; and applying the optical power deviation to the control voltage during the printing period to provide a result and applying the result to the laser diode.

8. An apparatus for controlling power of a laser diode, the apparatus comprising:

an output voltage sensing unit, which senses an output voltage of the laser diode;

an optical power compensation storage unit, which stores in a look-up table optical power deviation values corresponding to positions of a photosensitive drum and compensation values for each of the optical power deviation values;

an output voltage control unit, which generates a control voltage based on the sensed output voltage of the laser diode and calculates an error voltage between a reference voltage and the sensed output voltage of the laser diode; and an optical power compensation unit, which receives the generated control voltage and generates a compensated control voltage by one of directly adding and subtracting one or more of the stored compensation values corresponding to the optical power deviation from the generated control voltage to compensate for an optical power deviation due to differences in optical power accumulation on the photosensitive surface on the image forming apparatus, wherein the output voltage control unit proportionally integrates the error voltage during a power control period and transmits a proportional integration result to the optical power compensation unit.

9. The apparatus of claim 8, wherein the optical power compensation unit comprises: a calculator, which generates the compensated control voltage by adjusting the control voltage using the voltage deviation stored in the optical power compensation storage unit during the printing period.

10. The apparatus of claim 8, wherein the output voltage sensing unit comprises:

an analog-to-digital converter, which measures output voltages of the laser diode during the power control period and digitizes the output voltages of the laser diode; and a calculator, which averages the output voltages of the laser diode and transmits the average of the digitized output voltages of the laser diode to the output voltage control unit.

11. An apparatus for controlling power of a laser diode of an image forming apparatus, the apparatus comprising:

a video signal generator for generating a video signal;

a power controller for controlling a control voltage to be applied to the laser diode using an error voltage;

a combiner for combining an output of the video signal generator and output signal of the power controller to generate a laser diode driving voltage;

a laser diode driving unit for applying the laser diode driving voltage to the laser diode;

an optical power deviation storage which stores optical power deviations and compensation values by which the optical power deviations should be respectively compensated;

an output voltage control unit, which calculates the error voltage based upon a difference between a reference voltage and a sensed output voltage of the laser diode, the error voltage being proportionally integrated to generate the control voltage to compensate for an optical power deviation due to differences in optical power accumulation on a photosensitive surface on an image forming apparatus by one of directly adding and subtracting a predetermined compensation value corresponding to the optical power deviation and stored in the optical power deviation storage from the generated control voltage according to the differences in optical power accumulation; and an optical power compensation unit, which receives the generated control voltage and generates a compensated control voltage to compensate for an optical power deviation on a photosensitive drum having the photosensitive surface.

12. A method of controlling power of a laser diode, the method comprising:

receiving an output voltage of a laser diode during a power control period and generating a control voltage based on the received output voltage of the laser diode;

sampling an output voltage of the laser diode a predetermined number of times;

averaging the sampled output voltages and calculating an error voltage as being between a reference voltage and the average of the sampled output voltages;

generating a control voltage by proportionally integrating the calculated error voltage;

storing in a look-up table optical power deviation values corresponding to positions of a photosensitive drum and compensation values for each of the optical power deviation values, the compensation values varying depending on a distance from each point on the photosensitive drum to a center of the photosensitive drum to compensate for generally lower optical power at either side of the photosensitive drum than at the center of the photosensitive drum; and generating a compensated control voltage by one of directly adding and subtracting one or more of the stored compensation values corresponding to an optical power deviation on the photosensitive drum from the generated control voltage to compensate for the optical power deviation on the photosensitive drum, wherein the receiving the output voltage of the laser diode comprises sensing the output voltage of the laser diode during the power control period and generating an error voltage between the sensed output voltage of the laser diode and a reference voltage.

* * * * *

UNITED STATES PATENT AND TRADEMARK OFFICE

CERTIFICATE OF CORRECTION

PATENT NO. : 7,911,491 B2
APPLICATION NO. : 10/992007
DATED : March 22, 2011
INVENTOR(S) : Jung-tag Gong et al.

It is certified that error appears in the above-identified patent and that said Letters Patent is hereby corrected as shown below:

Column 9, Line 10 in Claim 6, delete “claim 5” and insert -- claim 5, --, therefor.

Signed and Sealed this
Thirty-first Day of May, 2011

David J. Kappos

David J. Kappos
*Director of the United States Patent and Trademark Office*